United States Patent [19]

Siaens et al.

[11] 4,404,491

[45] Sep. 13, 1983

[54] ELECTRIC INCANDESCENT LAMP

[75] Inventors: Gustaaf F. R. Siaens; Johannes M. A. Van der Heijden, both of Eindhoven, Netherlands

[73] Assignee: U.S. Philips Corporation, New York, N.Y.

[21] Appl. No.: 200,713

[22] Filed: Oct. 27, 1980

[30] Foreign Application Priority Data

Nov. 9, 1979 [NL] Netherlands ..... 7908214

[51] Int. Cl.[3] ..... H01J 5/50

[52] U.S. Cl. ..... 313/318; 313/331; 403/326

[58] Field of Search ..... 313/318, 331; 403/DIG. 6, DIG. 7, 326

[56] References Cited

U.S. PATENT DOCUMENTS

| | | | |
|---|---|---|---|
| 738,503 | 0/1903 | Waters | 285/321 |
| 1,442,223 | 1/1923 | Knebusch | 403/326 |
| 2,625,343 | 1/1953 | Foote | 403/DIG. 7 |
| 3,001,097 | 9/1961 | Smialek | 313/331 |
| 3,403,930 | 10/1968 | Bernier | 285/321 |
| 3,448,322 | 6/1969 | Millikan | 313/331 |
| 3,555,342 | 1/1971 | McFall | 313/331 |
| 3,672,708 | 6/1972 | Zemberry | 403/326 |
| 4,039,886 | 8/1977 | Scherzer | 313/331 |
| 4,113,287 | 9/1978 | Tikhonovich et al. | 285/321 |
| 4,229,950 | 10/1980 | Fessenden | 285/321 |
| 4,281,601 | 8/1981 | Overman | 403/326 |

*Primary Examiner*—Harold A. Dixon

*Attorney, Agent, or Firm*—Robert S. Smith

[57] ABSTRACT

In some types of electric incandescent lamps a cylindrical contact cap is connected to the part of the current supply conductor projecting beyond the pinch seal of the lamp envelope, which cap is mounted in an insulator sleeve. In known lamps the ceramic insulator sleeve 9 is secured on the pinch seal by means of cement.

In lamps according to the invention, the insulator sleeve is coupled to the contact cap by means of a metal spring.

3 Claims, 9 Drawing Figures

ELECTRIC INCANDESCENT LAMP

The invention relates to an electric incandescent lamp having a tubular glass lamp envelope which is sealed in a vacuum-tight manner at each end by means of a pinch and in which an incandescent filament is accommodated between current supply conductors each of which extends through a respective pinch and emanates at the end face of the pinch extending transversely to the axis of the lamp envelope, each supply conductor being connected outside the pinch to a respective cylindrical contact cap which is mounted in an insulator sleeve. Such lamps having a ceramic insulator sleeve are described inter alia in German Pat. No. 1,130,519.

By using the insulator sleeve, live parts of the lamp cannot be touched once the lamp has been placed in a lamp holder. In the known lamp the insulator sleeve is secured to the pinch of the lamp envelope by means of cement. This method of securing is time-consuming and hence expensive.

It is the object of the invention to provide a lamp in which the use of cement for assembling the insulator sleeve is avoided, while nevertheless an insulator sleeve of a material which can withstand high temperatures can be used.

This object is achieved in a lamp of the kind described in the opening paragraph in that the insulator sleeve is coupled to the contact cap by means of a metal spring.

In an embodiment the outer surface of the cylindrical contact cap and the inner surface of the insulator sleeve each have a respective circumferentially-extending groove, which grooves are aligned opposite to each other and together enclose a metal spring ring which thereby irremovably couples the insulator sleeve to the contact cap.

In this embodiment the insulator sleeve is mounted in a simple and rapid manner by sliding the sleeve axially over the contact cap (mounted on the current supply conductor) towards the lamp envelope, during which process the metal spring ring is forced into the groove in the contact cap. This latter can be effected by means of a tool or by the sleeve itself if the sleeve, at its end facing the lamp envelope, has a larger inside diameter than near its groove.

In a second embodiment the insulator sleeve has an abutment on its inner surface and the metal spring is in the form of a sleeve and comprises projecting lugs which together enclose the abutment in the insulator sleeve and furthermore comprises inwardly directed lugs which fix the spring relative to the contact cap.

In this embodiment the contact cap may comprise a groove in its outer surface in which the inwardly directed lugs engage. Another possibility is that the contact cap on its cylindrical surface has a shoulder on either side of which the inwardly directed lugs engage.

An attractive aspect of this second embodiment is that the insulator sleeve need not have a local widening between its ends. In the first embodiment on the contrary, the sleeve has a groove. This means that the insulator sleeve of the second embodiment is much easier to manufacture.

The sleeve-shaped spring may be a tubularly curved leaf spring, or a tube from the wall of which lugs have been bent.

As is also the case in known lamps, the insulator sleeve may have at one end two longitudinal diametrically oppositely extending slots in which the pinch of the lamp envelope is partly incorporated. As a result of this ample tolerances may be imposed on the length of the insulator sleeve.

In a special embodiment the cylindrical contact cap bears against the end face of the adjacent pinch. This has for its advantage that the current supply conductor which carries the contact cap is not mechanically loaded when the insulator sleeve is mounted.

The construction of the lamp according to the invention permits materials for the insulator sleeve to be used which are not elastically deformable and which can withstand relatively high temperatures; for example thermohardening synthetic resins such as silicone resins, for example polyphenylmethylsiloxane mixed or not mixed with a filler such as quartz flour or quartz fibre, and ceramic materials such as steatite. Alternatively, those thermoplastic resins may be used that are resistant to temperatures of about 300° C., such as polyimides and polyamide-imides based, for example on pyromellitic acid. Although these resins are thermoplastic, they have such a large deformation resistance at temperatures up to about 300° C. that they are negligibly elastically deformable at lower temperatures.

German Auslegeschrift No. 2,539,459 now U.S. Pat. No. 4,039,886 discloses lamps in which the insulator sleeve is also connected without cement. However, in this lamp an elastically deformable insulator sleeve of thermoplastic material is used which hence may be exposed to relatively low temperatures only. In the construction according to this Auslegeschrift, however, the use of elastically deformable material is essential. In fact, the insulator sleeve and the contact cap are matched to each other as regards shape and dimensions in such manner that the sleeve during assembly is deformed when it is slid over the contact cap and then assumes its original shape when, fitted in place, it engages recesses or ribs in the contact cap.

The lamp according to the invention may be destined for use as a projection lamp, a studio lighting lamp, a flood lamp, a copying lamp or as a heat radiator and it may or may not have a halogen-containing gas filling.

Embodiments of the lamp according to the invention are shown in the accompanying drawing, of which:

Figure 1:
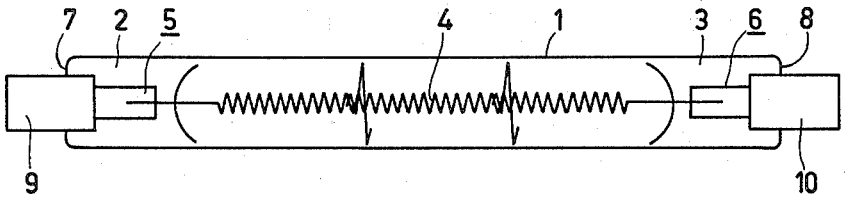
FIG. 1 is a side elevation of an electric incandescent lamp.

In FIG. 1, a tubular quartz glass lamp envelope 1 has pinches 2 and 3 through which respective current supply conductors 5 and 6 are passed to the filament 4. The pinches 2 and 3 have respective end faces 7 and 8 extending transversely to the tube axis of the lamp envelope. 9 and 10 denote ceramic insulator sleeves.

Figure 2:
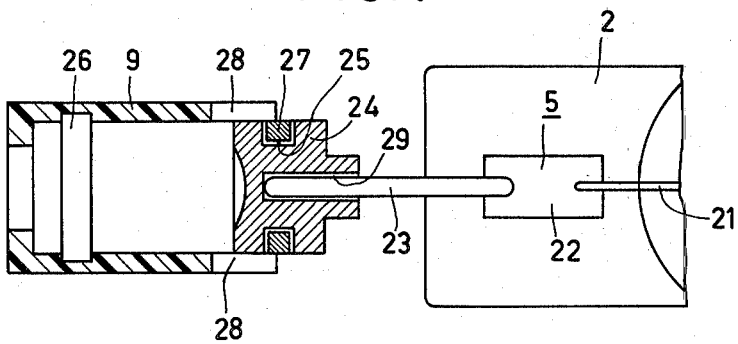
FIG. 2 is partly a side elevation, partly a sectional view of a detail of the lamp shown in FIG. 1 prior to assembling the insulator sleeve.

In FIG. 2 the current supply conductor is built up from an internal current conductor 21, a metal foil 22 as a lead-through, and an external current conductor 23. The external current conductor 23 is accommodated in an axial cavity 29 and is welded to a cylindrical contact cap 24. The contact cap 24 has a circumferentially-extending groove 25 in which a spring ring 27 of spring steel is present. The spring ring 27 is forced in the groove 25 by means of tongs (not shown), after which a ceramic insulator sleeve 9 is slid onto the contact cap 24. The insulator sleeve 9 has an internal circumferentially-extending groove 26 and longitudinal slots 28. The grooves 25 and 26 preferably, but not necessarily, extend around the whole circumference.

Figure 3:
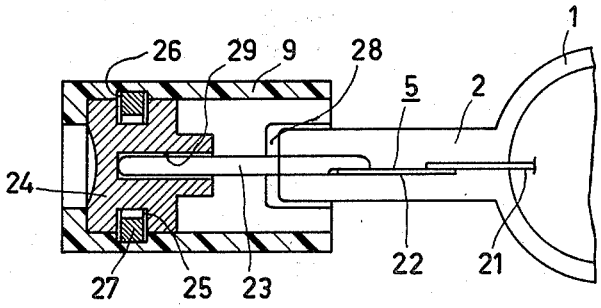
FIG. 3 shows the detail of FIG. 2 with assembled insulator sleeve rotated through an angle of 90°.

In FIG. 3 the insulator sleeve 9 engages around the pinch 2 of the lamp envelope 1 due to the groove 28. The insulator sleeve 9 is slid further towards the lamp envelope such that the spring ring 27 has expanded into the groove 26 of the insulator sleeve 9. The grooves 25 and 26 are now aligned opposite to each other and enclose the spring ring 27. This ring irremovably couples the insulator sleeve 9 to the contact cap 24.

Figure 4:
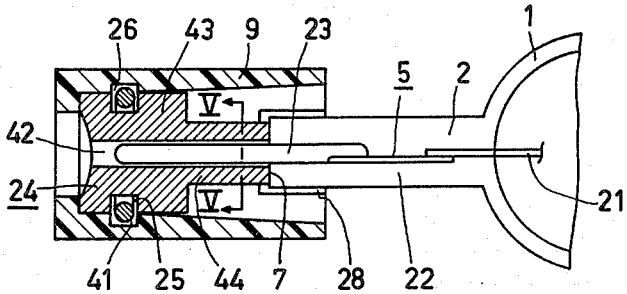
FIG. 4 shows a modified embodiment of FIG. 3.

In FIG. 4 a narrow portion 44 of the contact cap 24 abuts against the end face 7 of pinch 2. The contact cap has an axial bore 42 in which part 23 of the current supply conductor 5 is incorporated and is secured to the cap 24 by means of solder. Provided in the wide portion 43 of the contact cap 24 is the circumferential groove 25 in which a resilient annular wire 41 is present. The groove 25 is again in alignment with the groove 26 in ceramic insulator sleeve 9. The two grooves 25 and 26 enclose the spring ring 41. The spring ring 41 irremovably couples the insulator sleeve 9 to the contact cap 24. The inside diameter of the insulator sleeve decreases from the end adjacent the pinch 2 towards the groove 26. As a result of this the insulator sleeve 9 can easily be slid over the contact cap 24 and the spring ring 41 present in the groove 25, the insulator sleeve 9 urging the spring ring 41 more and more into the groove 25 until the grooves 25 and 26 become aligned and the spring ring 41 relaxes and engages groove 26.

Figure 5:
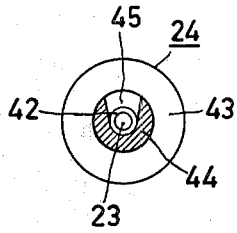
FIG. 5 is a sectional view of a modified embodiment of the contact cap of FIG. 4 taken on the line V—V.

In FIG. 5 the wide portion 43 and the narrow portion 44 of the contact cap have an axially-extending channel 42 in which part 23 of the current supply conductor (5 in the preceding Figures) is incorporated. The wall of the narrow portion 44 is removed locally so as to form an aperture for making a soldered joint between the current supply conductor (23, 5) and the contact cap 24.

Figure 6:
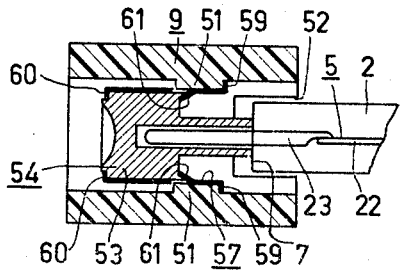
FIG. 6 is partially a side elevation and partially a sectional view of a detail of the lamp shown in FIG. 1 in another embodiment.
Figure 7:
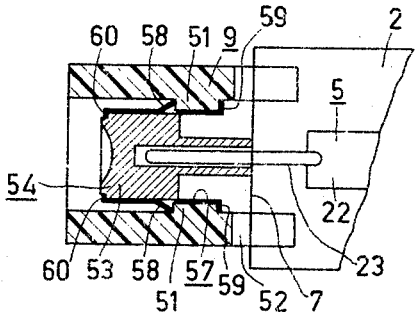
FIG. 7 shows the embodiment of FIG. 6 rotated over an angle of 90°.

In FIGS. 6 and 7 an insulator sleeve 9 is placed on the pinch 2 and engages through the grooves 52 around the pinch 2. A metal foil 22 to which an external current conductor 23 is welded which is secured to a contact cap 54 is incorporated in the pinch 2.

The insulator sleeve 9 is coupled to the contact cap 54 by means of a sleeve-shaped metal spring 57.

On its inner surface the insulator sleeve has an abutment 51 which is enclosed by projecting lugs 58 and 59 (FIG. 6) of the metal spring 57.

The contact cap 54 has a shoulder 53 on either side of which inwardly directed lugs 60 and 61, respectively, engage.

Figure 8:
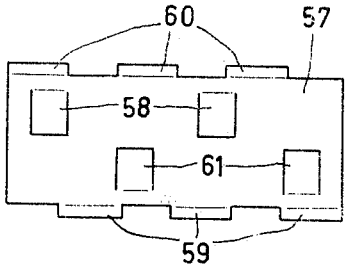
FIG. 8 shows the metal spring of FIGS. 6 and 7 developed in the flat plane.

When the metal spring 57 (FIG. 8), after the lugs have been bent out of the plane of the drawing, has been given the shape of a sleeve in such manner that the spring tends to assume a flatter shape, it is preferably slipped into the insulator sleeve 9 (in FIGS. 6 and 7 from the right to left). The lugs 58 first are forced inwardly and then spring back outwardly after having passed the abutment 51. The insulator sleeve 9 is then together with the metal spring 57 moved over the contact cap 54 (in FIGS. 6 and 7 from left to right), in which the lugs 61 are first pressed outwardly to spring back again after having passed the shoulder 53 of the contact cap 54.

Conversely, when the sleeve-shaped metal spring 57 has an inwardly directed pretension, it may first be moved over the contact cap 54 after which the insulator sleeve 9 is provided.

The lugs 59 and 60, respectively, may alternatively form one assembly.

Figure 9:
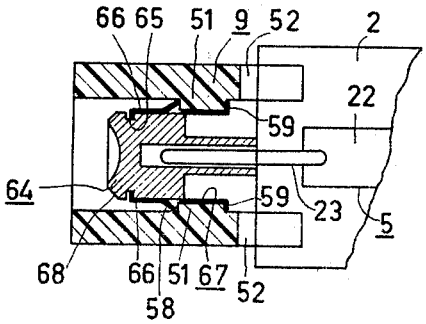
FIG. 9 shows a modified embodiment of FIG. 6.

In FIG. 9 the metal spring 67 has similar lugs 58 and 59 for enclosing the abutment 51 of the insulator sleeve 9. The contact cap 64 has a groove 65 in which resilient lugs 66 engage as a result of which the spring 67 is fixed relative to the contact cap 64. The contact cap 64 has an inclined edge 68 against which the resilient lugs 66 may travel when the metal spring 67 is provided and as a result of which said lugs 66 are temporarily bent outwardly.

What is claimed is:

1. An electric incandescent lamp having a tubular glass lamp envelope which is sealed in a vacuum-tight manner at each end by means of a pinch and in which an incandescent filament is accommodated between current supply conductors each of which extends through a respective pinch and emanates at the end face of the pinch extending transversely to the axis of the lamp envelope, each supply conductor being connected outside the pinch to a respective cylindrical contact cap which is mounted in an insulator sleeve, characterized in that the insulator sleeve is coupled to the contact cap, by means of a metal spring and further, characterized in that the insulator sleeve has an abutment on its inner surface and that the metal spring is in the form of a sleeve and has projecting lugs which together enclose the abutment in the insulator sleeve and has inwardly directed lugs which fix the spring relative to the contact cap.

2. An electric incandescent lamp as claimed in claim 1, characterized in that on its cylindrical surface the contact cap has a shoulder on either side of which the inwardly directed lugs engage.

3. An electric incandescent lamp as claimed in either of claims 1 or 2, characterized in that the cylindrical contact cap bears against the said end face of the adjacent pinch.

* * * * *